US009486024B2

(12) United States Patent
Kim et al.

(10) Patent No.: US 9,486,024 B2
(45) Date of Patent: Nov. 8, 2016

(54) HAIR EXTENSION

(71) Applicant: Chade Fashions, Inc., Niles, IL (US)

(72) Inventors: Tara Kim, Morton Grove, IL (US); Mikko Dooley, Chicago, IL (US)

(73) Assignee: Chade Fashions, Inc., Niles, IL (US)

( * ) Notice: Subject to any disclaimer, the term of this patent is extended or adjusted under 35 U.S.C. 154(b) by 4 days.

(21) Appl. No.: 14/644,543

(22) Filed: Mar. 11, 2015

(65) Prior Publication Data

US 2016/0262482 A1 Sep. 15, 2016

(51) Int. Cl.
*A41G 3/00* (2006.01)
*A41G 5/00* (2006.01)

(52) U.S. Cl.
CPC ..... *A41G 5/0053* (2013.01)

(58) Field of Classification Search
CPC .. A41B 5/004; A41B 5/0046; A41B 5/0053; A41B 5/006; A41B 5/0066
See application file for complete search history.

(56) References Cited

U.S. PATENT DOCUMENTS

2003/0159705 A1* 8/2003 Ferguson ..... A41G 5/0073 132/201
2008/0163882 A1* 7/2008 Owens ..... A41G 5/0046 132/201
2010/0059079 A1* 3/2010 Tokko ..... A41G 5/0066 132/201

FOREIGN PATENT DOCUMENTS

CA 2398739 * 7/2002

* cited by examiner

*Primary Examiner* — Todd E Manahan
*Assistant Examiner* — Brianne Kalach
(74) *Attorney, Agent, or Firm* — Levenfeld Pearlstein, LLC

(57) ABSTRACT

A hair extension for attachment to a person's head including a plurality of hair sections held together by a track, and methods of attaching the same are provided. The hair extension is configured such that the plurality of hair sections can move upward and downward freely with person's natural hair when styling.

18 Claims, 6 Drawing Sheets

HAIR EXTENSION

BACKGROUND

The following description relates to hair extensions.

Hair extensions can provide instant length, fullness, and enhance the appearance of a user. Many types of hair extensions are available for different methods of attachment. For example, small sections of hair may be attached to a user one by one via braiding, tying, bonding, clamping, shrink tubing, weaving, gluing, etc. Such attachment methods are also referred to as strand-by-strand attachment, and provide relatively light weight hair extensions that can move with user's natural hair when styling. However, a strand-by-strand attachment method is time intensive and relatively expensive.

A weft hair extension is a more cost effective and less time intensive option. A weft hair extension typically includes a weft extending along the top, on which a swathe of hair is attached. The weft hair extension may be attached to a user using micro rings, clamping, braiding, tying, bonding, tape, glue or by sewing to user's hair. For example, a section of user's hair may be held together close to user's scalp by a double sided tape, and a weft hair extension may be attached to one side of the tape. Subsequently, the weft hair extension and the attached hair are pulled upwards and another weft extension may be attached on the other side of the tape. A weft hair extension may also be sewn to user's hair. In this method user's hair may be braided, for example into cornrows, to which a weft hair extension may be sewn in.

Weft hair extensions can be attached faster than hair extensions attached by the strand by strand method, and they are less costly. However, since hair strands are fixed on a weft, movement of the hair extension is limited and styling of hair is more difficult. Further, due to the relatively bulky nature of the weft, the hair extension is more visible than those attached via strand-by-strand method, especially when hair is pulled up in an up-style, such as a ponytail.

Accordingly, it is desirable to provide a hair extension that can be attached relatively quickly and look natural in various hair styles.

SUMMARY

According to one embodiment there is provided a hair extension for attachment to a person head. The hair extension includes a plurality of hair sections held together by a track. Each of the plurality of hair sections includes a plurality of hair strands and a loop arranged proximate one end of the hair section. The hair extension is configured such that the each of the plurality of the hair sections rotates about the track freely.

The loop may be formed by holding together the plurality of hair strands in a bundle and bending one end of the bundle over and around the track. Further, each of the plurality of hair sections may include a wrap formed by tying together the plurality of hair strands proximate the loop, such that the loop is securely formed above the wrap and the plurality of hair strands are tightly held together by the wrap. The track may be threaded through the loop of each of the plurality of hair sections, such that the plurality of the hair sections hangs down from the track.

The plurality of hair strands may be synthetic hair or natural hair collected from another person. The wrap may be formed from an elastic thread. In an embodiment, the wrap is formed by tying an elastic thread multiple times around the hair section. The wrap may extend in a length of about 0.25 inch to about 1 inch. The track may be formed from a polymeric thread or a fishing line. In some embodiments, the track may include knots arranged proximate each end of the hair extension.

According to another embodiment there is provided a method of attaching a hair extension to a person's head. The method includes the step of providing a hair extension including a plurality of hair sections held together by a track, in which each of the plurality of hair sections includes a plurality of hair strands and a loop arranged proximate one end of the hair section. The hair extension is configured such that the each of the plurality of the hair sections rotates about the track freely. The method also includes the step of attaching the hair extension to a person head such that each the plurality of hair sections can be pulled up or down individually or together with person's hair when styling.

In the step of proving a hair extension, loop may be formed by holding together the plurality of hair strands in a bundle and bending one end of the bundle over and around the track. Further, each of the plurality of hair sections may include a wrap formed by tying together the plurality of hair strands proximate the loop, such that the loop is securely formed above the wrap and the plurality of hair strands are tightly held together by the wrap. The track may be threaded through the loop of each of the plurality of hair sections, such that the plurality of the hair sections hangs down from the track.

The plurality of hair sections may include a first peripheral hair section, a second hair section, a third hair section, and a last peripheral hair section, in which the first peripheral hair section is arranged at one end of the hair extension, and the last peripheral hair section is arranged at the other end of the hair extension. The second hair section may be arranged adjacent the first peripheral hair section, and the third hair section may be arranged adjacent the second hair section, and subsequent hair sections may be arranged between the third hair section and the last peripheral hair section to form the hair extension.

In one embodiment, the method may also include the step of weaving at least one micro stitch on a person's head. In such an embodiment, the step of attaching the hair extension may include the step of arranging the hair extension adjacent a micro stitch, and anchoring the first peripheral hair section to the micro stitch by sewing together the first peripheral hair section and the micro stitch using a thread and a needle, in which the thread is threaded through a loop of the first peripheral hair section.

The step of attaching the hair extension may also include the step of sewing together the micro stitch and the track between each of the plurality of hair sections. In one embodiment, the attachment between the first peripheral hair section and the micro stitch provides a first attachment point between the hair extension and the person's head. The step of attaching the hair extension may further include the step of sewing together the track and the micro stitch between the first peripheral hair section and the second hair section to provide a second attachment point, and sewing together the track and the micro stitch between the second hair section and the third hair section to provide a third attachment point, and sewing together the track and the at least one micro stitch between subsequent hair sections to provide a plurality of attachment points. The attachment points may be configured such that each of the plurality of hair sections rotates upward and downward freely.

In another embodiment, the method may include the step of braiding the person's hair to provide at least one braid. In such an embodiment, the step of attaching the hair extension may include the step of arranging the hair extension adjacent a braid, and anchoring the first peripheral hair section to the braid by sewing together the first peripheral hair section and the braid using a thread and a needle, in which the thread is threaded through a loop of the first peripheral hair section.

The step of attaching the hair extension may also include the step of sewing together the braid and the track between the plurality of hair sections. In an embodiment, the attachment between the first peripheral hair section and the braid provides a first attachment point between the hair extension and the person's head. The step of attaching the hair extension may further include sewing together the track and the braid between the first peripheral hair section and the second hair section to provide a second attachment point, and sewing together the track and the braid between the second hair section and the third hair section to provide a third attachment point, and sewing together the track and the braid between subsequent hair sections to provide a plurality of attachment points. The attachment points may be configured such that each of the plurality of hair sections rotates upward and downward freely.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
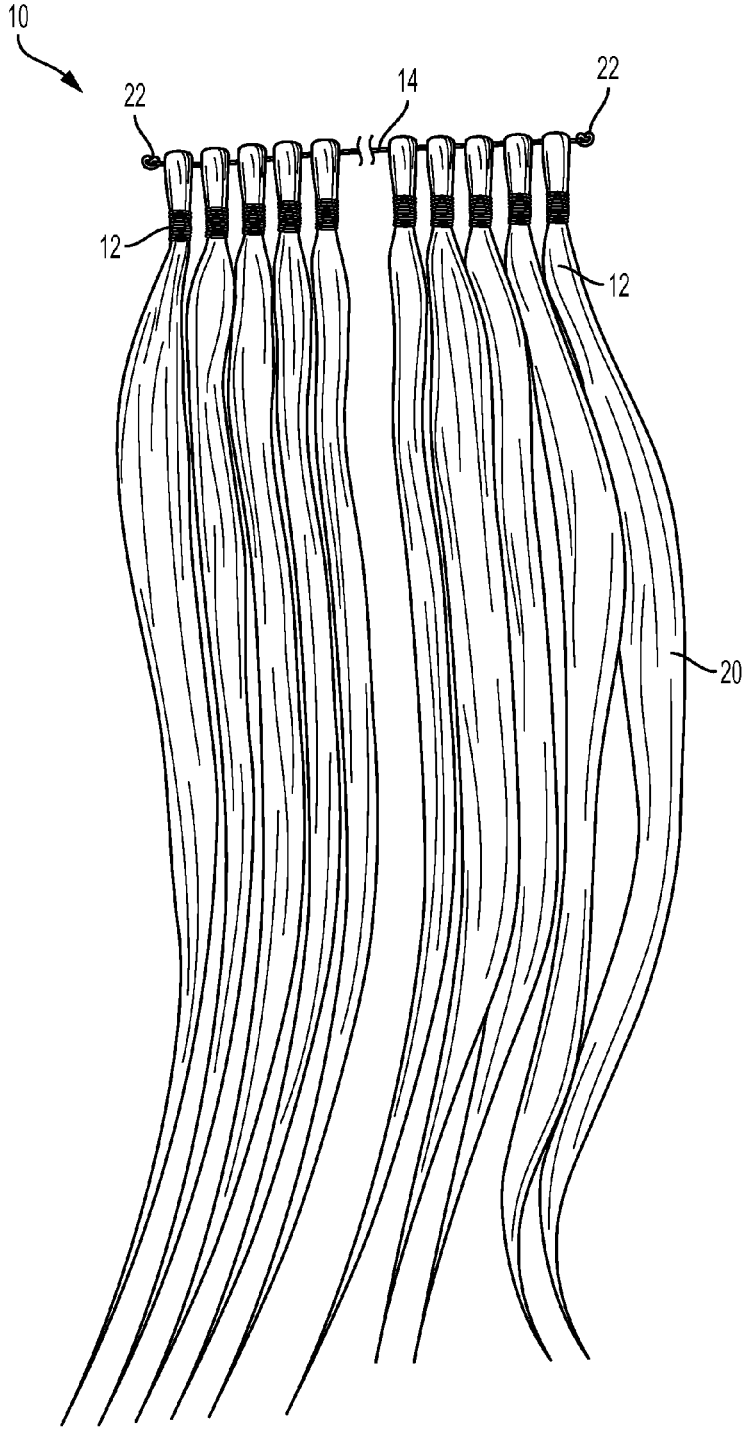
FIG. 1 is a perspective view of a hair extension including a plurality of hair sections according to an embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
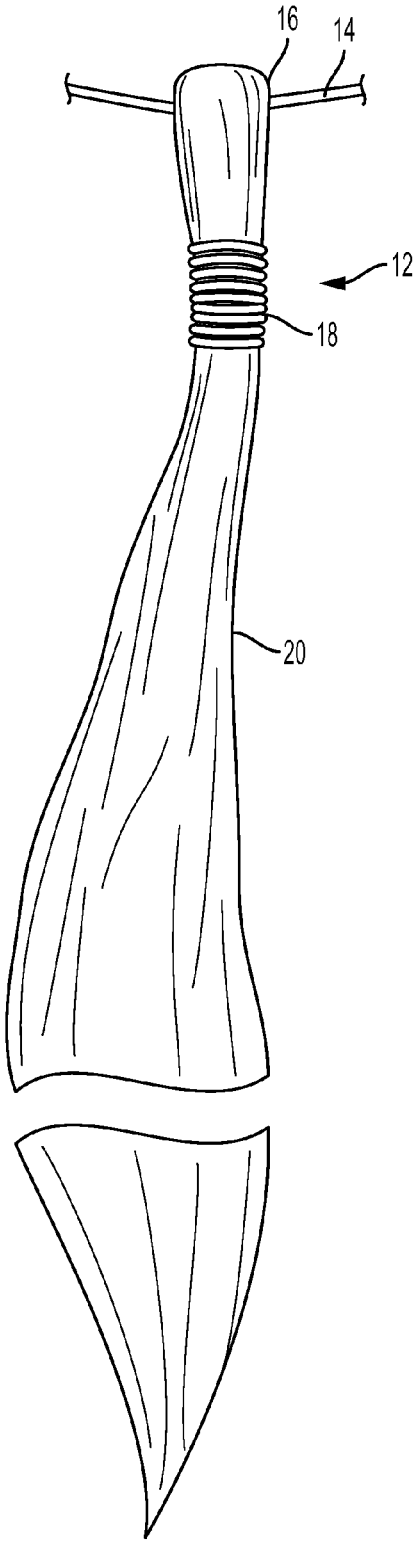
FIG. 2 is a top perspective view of a hair section according to an embodiment.
Figure 3:
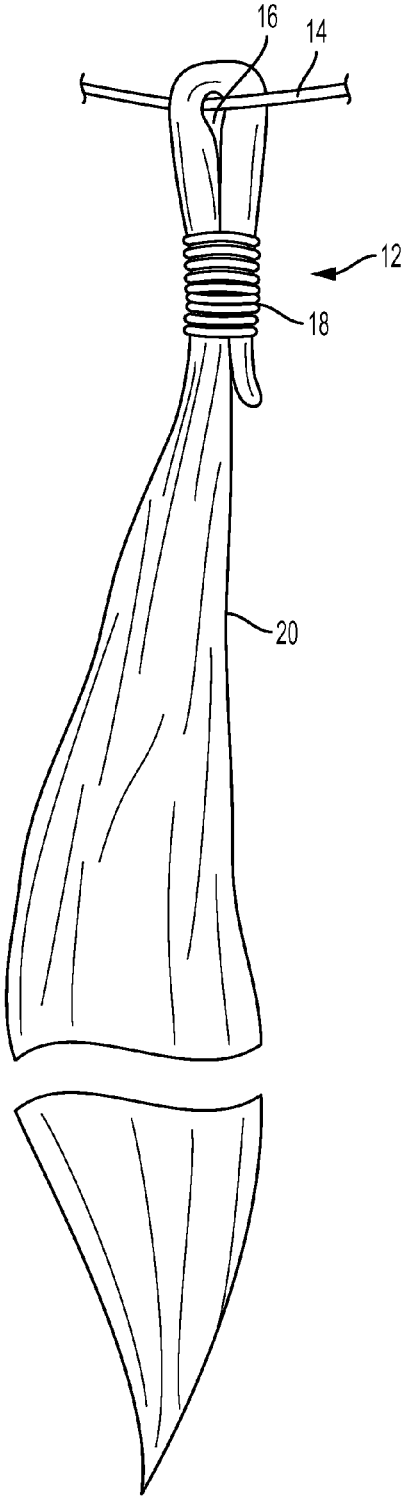
FIG. 3 is a side perspective view of the hair section of FIG. 2.

FIG. 1 is a perspective view of an embodiment of a hair extension 10 generally including a plurality of hair sections 12 held together by a track 14. FIGS. 2 and 3 are close-up illustrations of the hair section 12. Each of the hair sections 12 is formed using a small bundle of hair strands 20, which may be synthetic hair or natural hair collected from another person. In this embodiment, the hair section 12 includes a plurality of hair strands 20, such that the hair section 12 may be held between a person's thumb and index finger. The size, length, and color of hair section 12 may be varied according to user's natural hair and a desired hair style.

The hair section 12 may be formed by gathering a small bundle of hair strands 20 and bending one end of the bundle over and around the track 14 to provide a loop 16. The looped end of the hair bundle is tied proximate the loop 16 to provide a wrap 18, such that the loop 16 is securely formed above the wrap 18 and the hair strands 20 are tightly held together by the loop 16. The location of the wrap 18 may be adjusted to change the size of the loop 16, which may be determined according to a thickness of the track 14. The loop 16 may be sized such that the hair section 12 may rotate about the track 14 freely. In an embodiment, the loop 16 is formed by wrapping the bundle of hair strands 20 around the track 14, tying the wrapped hair strands 20 at the bottom of the loop 16 with a thread to form the wrap 18, and snipping off loose short hair strands under the wrap 18.

The wrap 18 may be formed using a suitable material that may be used to tightly tie around the looped hair strands 20, such that the hair strands 20 do not slip out from the hair section 12, and the loop 16 is securely formed above the wrap 18. Suitable materials for the wrap 18 include, but are not limited to, polymeric threads and yarns, such as nylon threads or elastic threads. In one embodiment, the wrap 18 is formed using an elastic thread. The elastic thread may be tied around the hair strands 20 multiple times proximate the looped end to form the wrap 18. The wrap 18 may extend vertically about 0.25 inches to about 1 inch long, more preferably about 0.5 inches to about 0.75 inches long. The color of the wrap 18 may be selected to generally match the color of the hair strands 20.

The track 14 may be formed using a suitable material to hold together a plurality of the hair sections 12 to form the hair extension 10. To form the hair extension 10, a bundle of hair strands 20 may be wrapped around the track 14 at one end to form the loop 16, such that the track 14 is threaded through the loop 16 of each of the plurality of the hair sections 12. Preferably, the track 14 is formed using a material having a low surface tension to allow sliding movement of the hair sections 12 across the track 14 and rotating movement about the track 14 with little resistance. Suitable materials for the track 14 include, but are not limited to, polymeric threads, such as a nylon thread, a fishing line, string and elastic threads. In one embodiment, each end of the track 14 is knotted 22 to prevent the hair sections 12 from sliding off the track 14.

The hair extension 10 may include any number of hair sections 12 according to a desired width of the hair extension 10. For example, the hair extension 10 may include a sufficient number of hair sections 12 to form a width of about 1 inch or more. The hair extension 10 may be provided in various widths, lengths, and colors.

The hair extension 10 may be attached to a user using various methods to maximize a natural look of the hair extension 10. Many different base anchors may be formed on a user's head to attach the hair extension 10. Examples of the base anchors include, but are not limited to, cornrows, various braid patterns, micro braids, micro stitching, lacing, tying, knotting, elastic treads, rubber bands, bonding, keratin bonds, and micro links.

Figure 4:
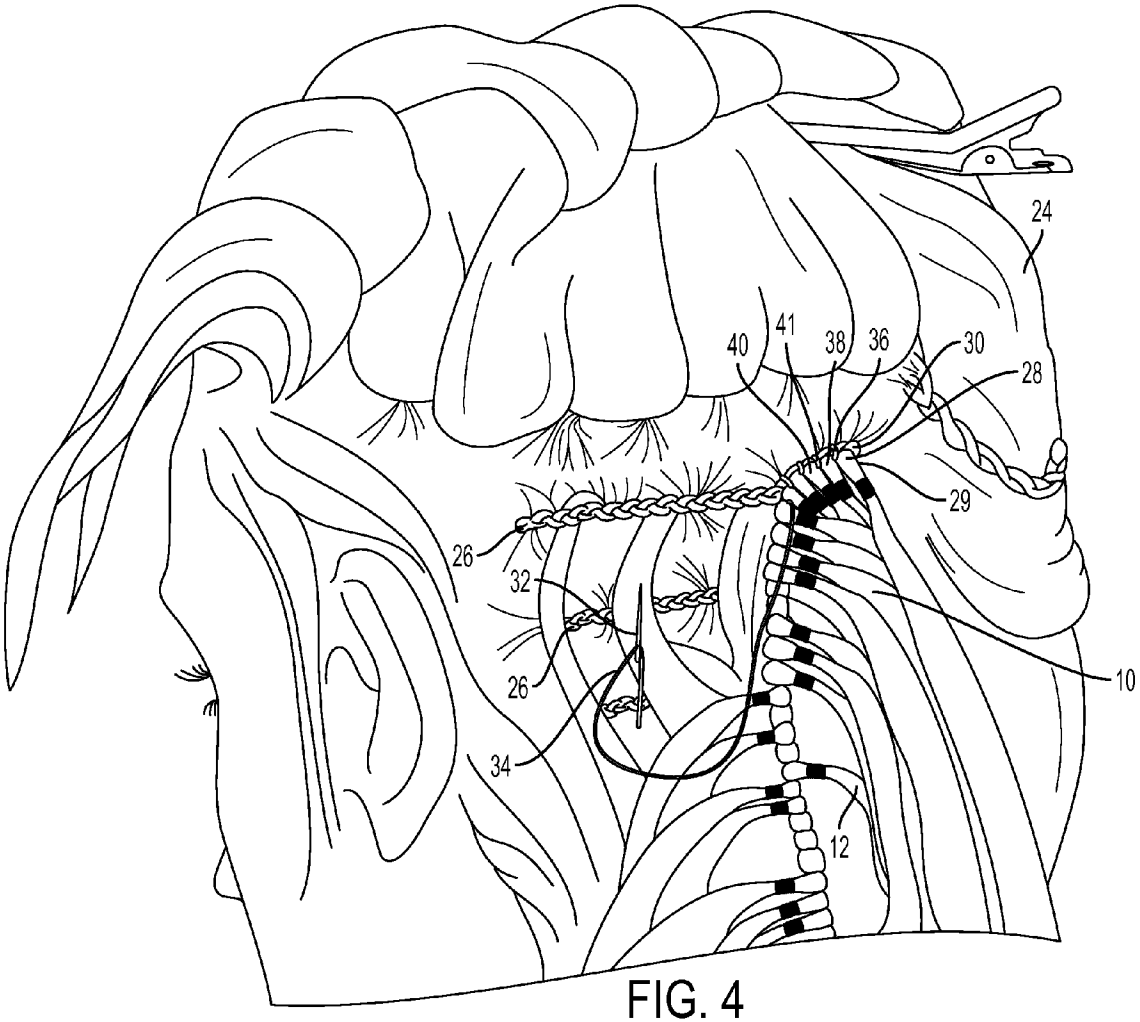
FIG. 4 is an illustration of the hair extension of FIG. 1 attached by a micro stitch attachment method according to an embodiment.

In one embodiment, the hair extension 10 is attached to a user by a micro stitch attachment method. FIG. 4 is an illustration of a micro stitch attachment method according to an embodiment. In this method, a hair dresser may weave a micro stitch 26 in a section of user's head 24. A micro stitch is formed by braidless weaving, in which a weft of thread is stitched directly onto a user's head. Depending on the desired appearance and style, a plurality of micro stitches 26 may be weaved on a user's head. The micro stitch 26 may be weaved across the width of user's hair line or in smaller sections as desired. After the micro stitch 26 is weaved, the hair extension 10 may be laid against the micro stitch 26, such that a first peripheral hair section 28 is adjacent one end 30 of the micro stitch 26. The hair extension 10 may be anchored by sewing the first peripheral hair section 28 to the micro stitch 26 by stitching together the first peripheral hair section 28 and the micro stitch 26 using a needle 32 and a thread 34, in which the thread 34 is stitched through a loop 29 of the peripheral hair section 28.

After one end of the hair extension 10 is anchored to the micro stitch 26 by stitching together the first peripheral hair section 28 and the micro stitch 26, the rest of the hair extension 10 may be attached by sewing the track 14 between hair sections 12 to the micro stitch 26, such that the hair sections 12 may lay generally flat against the micro stitch 26. Preferably, the track 14 may be sewn to the micro stitch 26 between the hair sections 12 by double stitching at each attachment point. For example, after the peripheral hair section 28 is anchored to the micro stitch 26, a second attachment point 36 may be provided between the first peripheral hair section 28 and a second hair section 38, in which the micro stitch 26 and the track 14 between the first peripheral hair section 28 and the second hair section 38 are sewn together by a double stitching. Similarly, a third attachment point 41 may be formed by sewing together the micro stitch 26 and the track 14 between the second hair section 38 and a third hair section 40, and so on. The micro stitch 26 and the track 14 are sewn together between each of the hair sections 12 until the hair extension 10 is attached across the micro stitch 26. The last peripheral hair section may be attached to the micro stitch 26 through a loop of the last peripheral hair section like the first peripheral hair section 28 to securely anchor the last peripheral hair section to the micro stitch 26. In case the hair extension 10 is wider than the micro stitch 26, the track 14 may be cut proximate the last peripheral hair section and knotted. The rest of the unused hair extension 10 may be used for other sections of user's head.

Another suitable attachment method is a braid attachment method. This method is similar to the micro stitch method described above except the hair extension 10 is attached to a braid on a user's head instead of a micro stitch. In this method, a hair dresser may braid user's hair to provide a braid as a base anchor. User's hair may be braided in many different ways and in various designs depending on a desired end result. For example, user's hair may be braided in sections, for example, quarter sections, to each of which the hair extension 10 is attached. Alternatively, a user's hair may be braided across the whole head.

Figure 5:
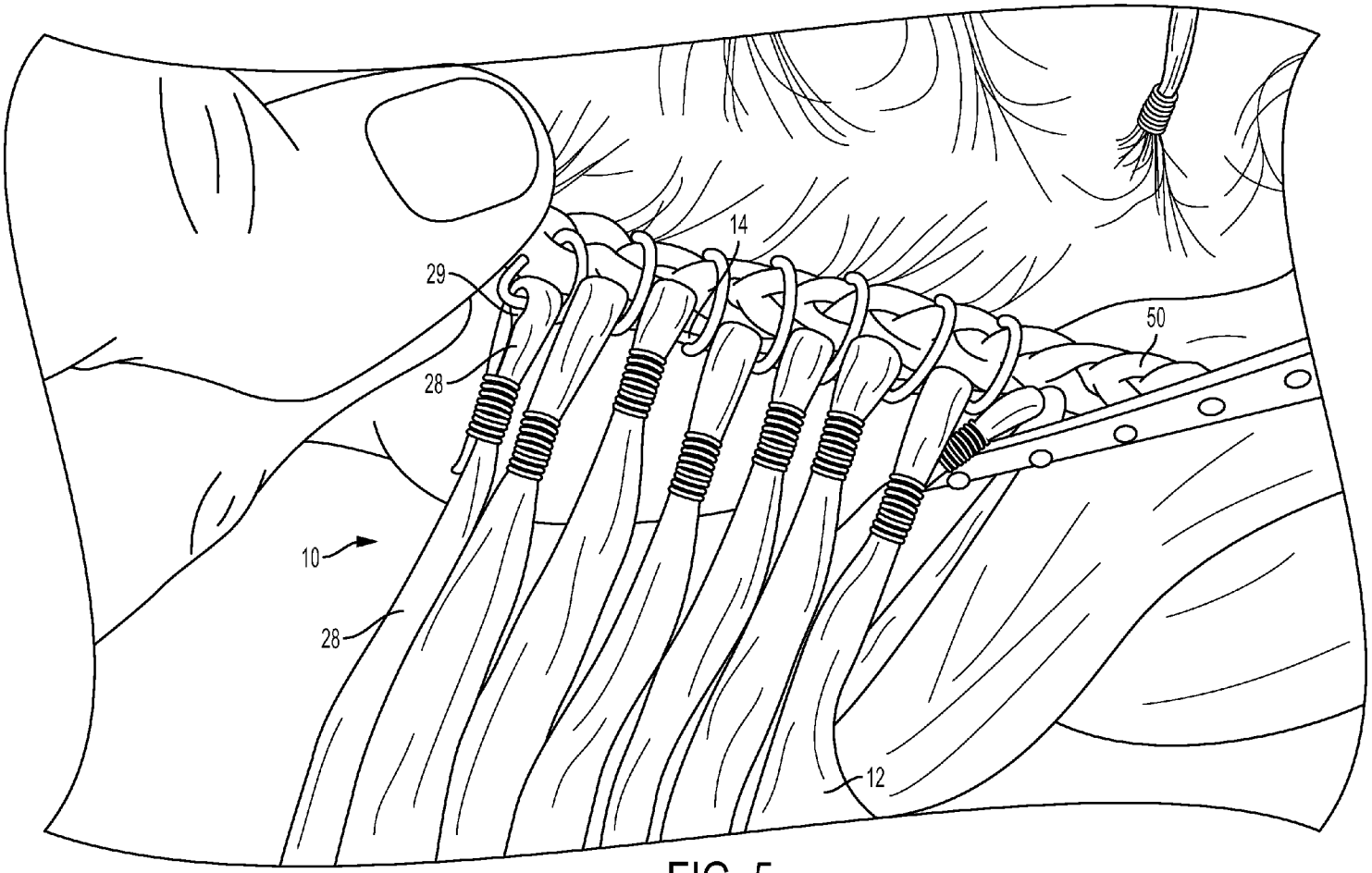
FIG. 5 is an illustration of the hair extension of FIG. 1 attached by a braid attachment method according to another embodiment.

FIG. 5 is an illustration of a braid attachment method according to an embodiment. As it was with the micro stitch attachment method, the hair extension 10 is laid against a braid 50, and the first peripheral hair section 28 is sewn to the one end of braid 50 through the loop 29 as it was with the micro stitch method. Subsequently, the braid 50 is sewn together with a track 14 between hair sections 12. The last peripheral hair section may be sewn to the braid 50 through a loop of the last peripheral hair section like the first peripheral hair section 28 to securely anchor the last peripheral hair section to the braid 50.

Figure 6:
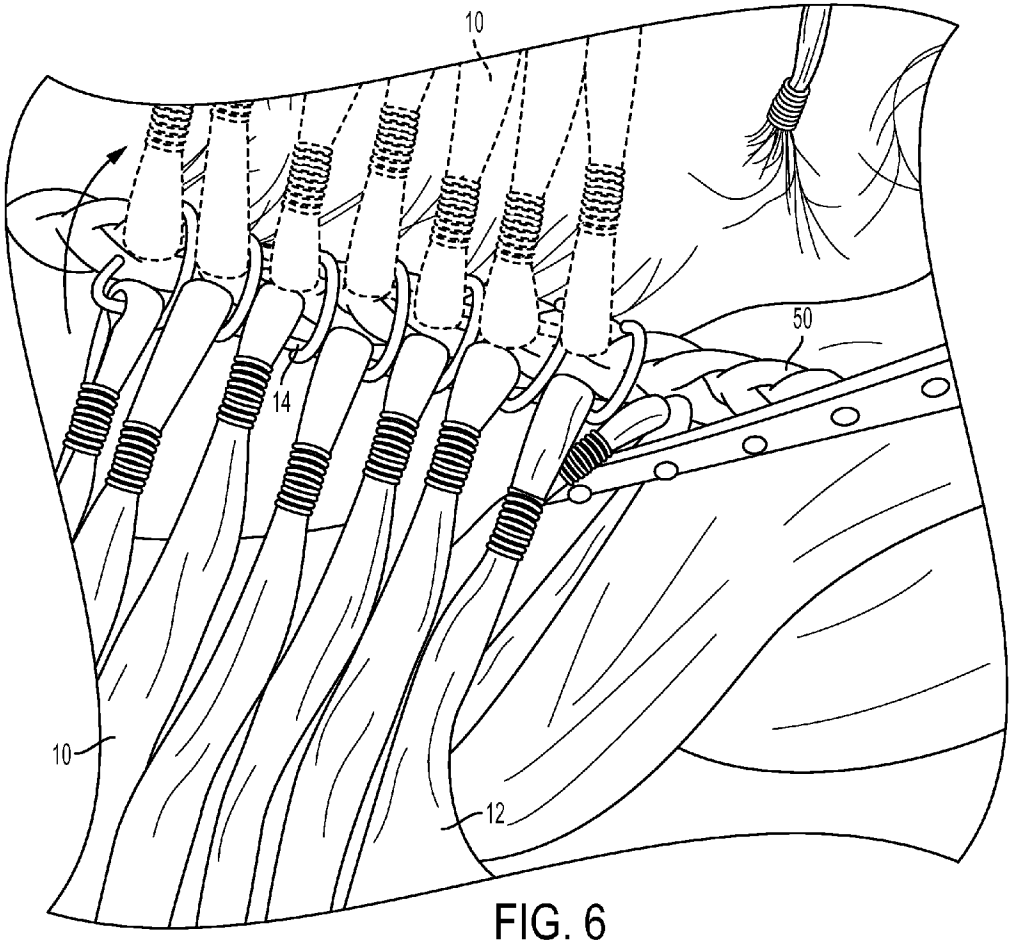
FIG. 6 is an illustration demonstrating a movement of the hair extension of FIG. 5 attached to a user's braid.

FIG. 6 illustrates a movement of the hair extension 10 attached to the braid 50. As shown, the attached hair extension 10 may be freely rotated upward and downward about the track 14. Thus, the user may easily style her hair up, such as in a ponytail. Because the hair sections 12 move up with the user's hair, the hair extension 10 lays flat in an up-style and is much less visible when compared to conventional weft extensions. The hair extension 10 including the plurality of hair sections 12 and the track, and the methods of attachments through the loop 16 and/or via the track provide the versatility and natural look of the hair extensions attached by a strand-by-strand method.

In other embodiments, the hair extension 10 may be attached by other anchoring methods. For example, each end of the hair extension 10 may be anchored to a user's head using keratin bond.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A hair extension for attachment to a person's head comprising:
   - a plurality of hair sections held together by a track comprising an elongated flexible element;
   - wherein each of the plurality of hair sections includes a plurality of hair strands and a loop arranged proximate one end of the hair section, wherein the loop is integrally formed in each of the plurality of hair sections by the plurality of hair strands, and the track passes through the loop of each of the plurality of hair sections such that the plurality of the hair sections hangs down from the track; and
   - wherein the hair extension is configured such that the each of the plurality of the hair sections rotates and slides longitudinally about the track freely.

2. The hair extension of claim 1, wherein the loop is formed by holding together the plurality of hair strands in a bundle and bending one end of the bundle over and around the track, wherein each of the plurality of hair sections includes a wrap formed by tying together the plurality of hair strands proximate the loop, such that the loop is securely formed above the wrap and the plurality of hair strands are tightly held together by the wrap.

3. The hair extension of claim 2, wherein the wrap is formed from an elastic thread.

4. The hair extension of claim 3, wherein the wrap is formed by tying the elastic thread multiple times around the hair section, wherein the wrap extends in a length of about 0.25 inch to about 1 inch.

5. The hair extension of claim 1, wherein the plurality of hair strands are synthetic hair or natural hair collected from another person.

6. The hair extension of claim 1, wherein the track is formed from a polymeric thread or a fishing line.

7. The hair extension of claim 1, the track includes a first knot and a second knot, each of the knots arranged proximate each end of the hair extension.

8. A method of attaching a hair extension to a person's head comprising the steps of:
   - providing a hair extension comprising:
     - a plurality of hair sections held together by a track comprising an elongated flexible element;
     - wherein each of the plurality of hair sections includes a plurality of hair strands and a loop arranged proximate one end of the hair section, wherein the loop is integrally formed in each of the plurality of hair sections by the plurality of hair strands, and the track passes through the loop of each of the plurality of hair sections such that the plurality of the hair sections hangs down from the track; and wherein the hair extension is configured such that the each of the plurality of the hair sections rotates and slides longitudinally about the track freely; and attaching the hair extension to a person head such that each the plurality of hair sections can be pulled up or down individually or together with person's hair when styling, wherein a base anchor is provided on a user's head and the hair extension is attached by sewing the track to the base anchor between the plurality of hair sections.

9. The method of claim 8, wherein the loop is formed by holding together the plurality of hair strands in a bundle and bending one end of the bundle over and around the track, wherein each of the plurality of hair sections includes a wrap formed by tying together the plurality of hair strands proximate the loop, such that the loop is securely formed above the wrap and the plurality of hair strands are tightly held together by the wrap.

10. The method of claim 8, wherein the plurality of hair sections comprises a first peripheral hair section, a second hair section, a third hair section, and a last peripheral hair section, wherein the first peripheral hair section is arranged at one end of the hair extension, and the last peripheral hair section is arranged at the other end of the hair extension, wherein the second hair section is arranged adjacent the first peripheral hair section, and the third hair section is arranged adjacent the second hair section, and subsequent hair sections are arranged between the third hair section and the last peripheral hair section to form the hair extension.

11. The method of claim 10, further including the step of weaving at least one micro stitch on a person's head to provide the base anchor, wherein the step of attaching the hair extension includes arranging the hair extension adjacent the at least one micro stitch, and anchoring the first peripheral hair section to the at least one micro stitch by sewing together the first peripheral hair section and the at least one micro stitch using a thread and a needle, wherein the thread is threaded through a loop of the first peripheral hair section.

12. The method of claim 11, wherein the step of attaching the hair extension includes sewing together the at least one micro stitch and the track between each of the plurality of hair sections.

13. The method of claim 12, wherein the attachment between the first peripheral hair section and the at least one micro stitch provides a first attachment point between the hair extension and the person's head, wherein the step of attaching the hair extension further includes sewing together the track and the at least one micro stitch between the first peripheral hair section and the second hair section to provide a second attachment point, and sewing together the track and the at least one micro stitch between the second hair section and the third hair section to provide a third attachment point, and sewing together the track and the at least one micro stitch between subsequent hair sections to provide a plurality of attachment points.

14. The method of claim 13, wherein the attachment points are configured such that each of the plurality of hair sections rotates upward and downward freely.

15. The method of claim 10, further including the step of braiding the person's hair to provide at least one braid, wherein the step of attaching the hair extension includes arranging the hair extension adjacent the at least one braid, and anchoring the first peripheral hair section to the at least one braid by sewing together the first peripheral hair section and the at least one braid using a thread and a needle, wherein the thread is threaded through a loop of the first peripheral hair section.

16. The method of claim 15, wherein the step of attaching the hair extension includes sewing together the at least one braid and the track between the plurality of hair sections.

17. The method of claim 16, wherein the attachment between the first peripheral hair section and the at least one braid provides a first attachment point between the hair extension and the person's head, wherein the step of attaching the hair extension further includes sewing together the track and the at least one braid between the first peripheral hair section and the second hair section to provide a second attachment point, and sewing together the track and the at least one braid between the second hair section and the third hair section to provide a third attachment point, and sewing together the track and the at least one braid between subsequent hair sections to provide a plurality of attachment points.

18. The method of claim 17, wherein the attachment points are configured such that each of the plurality of hair sections rotates upward and downward freely.

* * * * *